US006701549B1

(12) United States Patent
Eriksen

(10) Patent No.: US 6,701,549 B1
(45) Date of Patent: Mar. 9, 2004

(54) LEVEL HAMMOCK

(76) Inventor: Torben Eriksen, 12501 Sutherland Dr., Grass Valley, CA (US) 95949

( * ) Notice: Subject to any disclaimer, the term of this patent is extended or adjusted under 35 U.S.C. 154(b) by 0 days.

(21) Appl. No.: 10/260,667

(22) Filed: Sep. 30, 2002

(51) Int. Cl.[7] ..... A45F 3/22
(52) U.S. Cl. ..... 5/120; 5/123
(58) Field of Search ..... 5/120, 122, 121, 5/123, 98.3; 114/192, 193

(56) References Cited

U.S. PATENT DOCUMENTS 249,403 A * 11/1881 Robertson ..... 114/193
614,621 A * 11/1898 Palmer ..... 5/122
4,125,909 A * 11/1978 Jacobson ..... 5/121
5,913,772 A * 6/1999 Clark ..... 5/121

* cited by examiner

*Primary Examiner*—Heather Shackelford
*Assistant Examiner*—Lisa M. Saldano

(57) ABSTRACT

This disclosure describes a HAMMOCK design which compensates for sag. The lower part of the HAMMOCK becomes level when occupied and allows the user to lie flat on the back or the side as in a bed. The HAMMOCK is equally suited for recreation and camping and is simple to make and easy to install.

3 Claims, 3 Drawing Sheets

LEVEL HAMMOCK

BACKGROUND OF THE INVENTION

This invention relates to hammocks and, in particular, to a design that compensates for hammock sag without manual readjustment. My criteria were that the hammock had to be light and simple to install, easy to cover, and a better alternative to current hammock models, air mattresses, and foam pads.

Hammocks in one form or another have been in use for centuries. Other attempts have been made to create a level model.

In the Brazilian hammock, this was done by making the hammock bed so wide that the user could rest diagonally in its middle. The drawback is that the bed has to be held apart with adjustment cords not to impede the occupant. The hammock also funnels rainwater towards the user and is large and difficult to cover in wet weather.

Canvas and rope hammocks made flat by being very tightly strung were previously utilized in various navies. They could, however, only be slung in specific locations, took practice to install, and were not meant to be portable.

The Hennesy hammock, U.S. Pat. No. 6,185,763 B1, addresses the problem of hammock sag. It has an adjustable ridgeline for sag compensation. However, this has to be done manually and the line must be re-tightened depending on the load. Also, the Hennesy hammock has to be spread apart with side adjustment cords to allow the user to lie flat along its diagonal.

BRIEF SUMMARY OF THE INVENTION

This invention was made to create a flat, light and more comfortable alternative to resting on the ground using an air mattress or foam pad. To utilize a hammock was an obvious solution, but as most people are not comfortable sleeping on their back only, I found it necessary to re-design the conventional hammock so it had a flat bed. My hammock is portable, easy to install, and does not require re-adjustment depending on the load. It needs no side adjustment cords to be held apart and the user rests in it lengthwise which makes it compact and easy to install.

Originally my hammock was intended for long distance hikers who needed to travel light but the resulting product is equally well suited for home and garden use.

DETAILED DESCRIPTION OF THE INVENTION

This description is of a hammock that is designed so it compensates for hammock sag and becomes flat when loaded.

Figure 1:
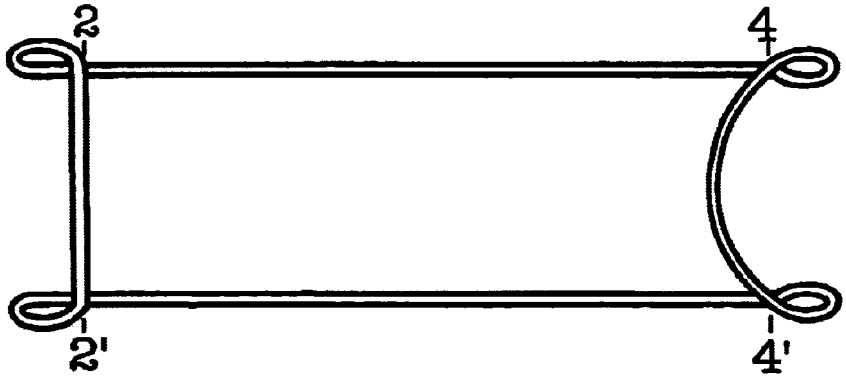
FIG. 1 shows a top view of the hammock's webbing frame only, including the loops for attaching the ropes that suspend it.

The hammock consists of a rectangular frame made from webbing, preferably nylon. The webbing is folded and joined together in each corner, so four loops for anchoring the hammock are created, FIG. 1. The two longer parallel pieces of webbing for the sides and the shorter piece for the foot end are joined at right angels, 2 and 2'. The fourth piece, 4 and 4' for the head end, is made long enough to form an arch, the secant of which is as long as the webbing at the foot end.

Figure 2:
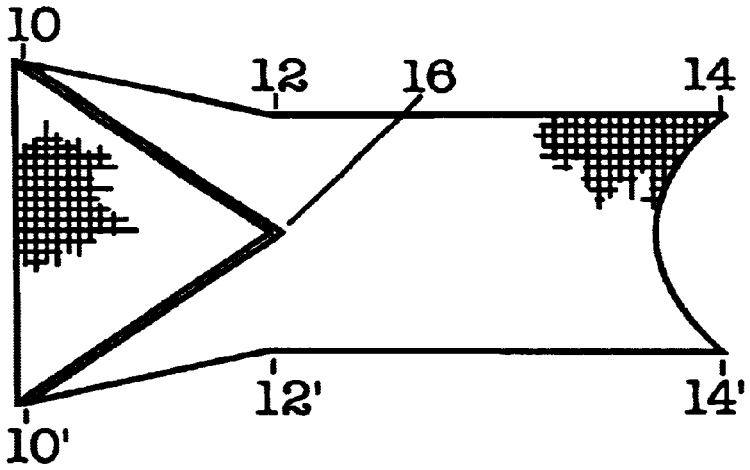
FIG. 2 is a top view of the hammock bed before being attached to the frame. It depicts the arched head end, the flared out foot end and the sewn-in webbing pieces.

For the hammock bed a section of pre-cut non extendable material, for instance UV-treated netting, is applied. Netting eliminates condensation between the sleeping bag and the hammock bed during cold conditions. The material for the bed must be cut to the same length as the webbing frame and fashioned to a curved shape at the head end that matches the curve of the webbing, FIG. 2, 14 and 14'. From the head end and for about two thirds of the length of the hammock, 12 and 12', the mesh for the bed must be slightly wider than the frame. For the remainder of its length it must gradually flare out to become one and one third wider than the frame at its foot end, 10 and 10'.

Two pieces of webbing are fastened to the foot end of the bed material in a V-shape. They terminate at the corners, FIG. 2, 10 and 10', and must be long enough to join at the middle of the bedding material where it starts flaring out, 16.

The sides of the hammock bed are fastened all along the sides of the webbing frame. As the bedding material at the front between 14 and 14' is a little wider than the length of the webbing 4 and 4' in FIG. 1, it must be gathered and slightly pleated all across as it is joined to the webbing. The flared out material at the foot end of the hammock is not attached to the frame. It will do part of the compensation for hammock sag.

Figure 3:
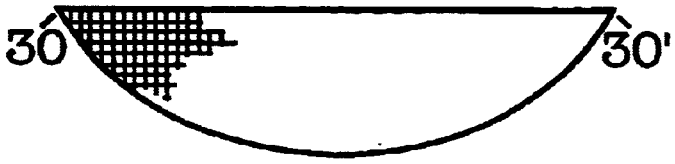
FIG. 3 shows the arched piece of netting before being attached to the foot end of the hammock.

An insert is required to give the material at the foot end a rounded shape across. The insert can be of the same type of material as the hammock bed and must be manufactured into a segment of a circle, FIG. 3. The arch of the circular segment, 30 and 30', must be as long as the netting is wide at the foot end of the hammock, FIG. 2, 10 and 10'. Secant 30 and 30' in FIG. 3 must be as long as the hammock frame is wide at the foot end. The straight part of segment 30 and 30' is fastened to the webbing of the frame in FIG. 1, 2 and 2'. The arch 30 and 30' is joined to the end of the flared out material depicted in FIG. 2, 10 and 10'.

Figure 4:
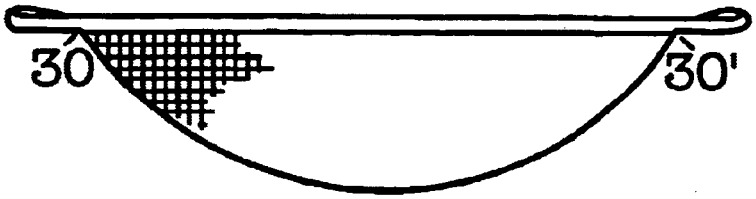
FIG. 4 is an end view of the hammock with the arched piece of netting attached.

In an end view the shape of the hammock's foot end is as indicated in FIG. 4. The circular segment fastened to the hammock also serves as a stop and a foot rest.

Figure 5:
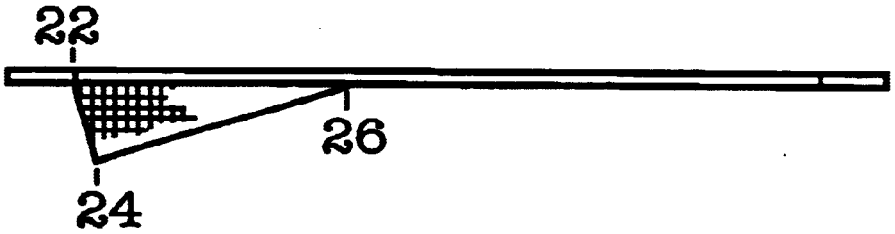
FIG. 5 depicts a side view of the hammock showing the built-in droop as it appears when the bed is not loaded.

Seen from the side the shape of the hammock without a load is now as shown in plan view FIG. 5. The flared out material at the foot end droops as indicated by 22, 24 and 26.

Figure 6:
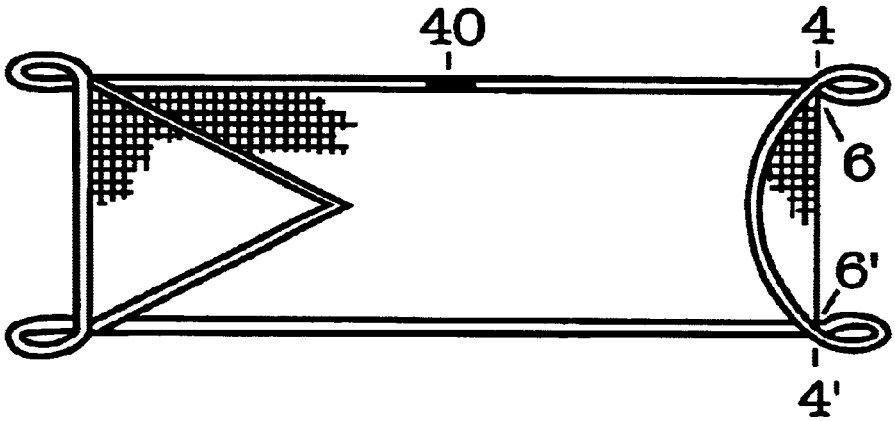
FIG. 6 is a top view of the hammock with the short level and the storage pocket attached.

FIG. 6 is an overhead view of the hammock. A short level, 40, is fastened midways along one of the hammock's sides, parallel with the webbing. It facilitates installing the hammock in equilibrium where no horizontal reference is visible, for instance on slopes. A storage compartment is added above the curved webbing at the head end. One side of the compartment is fastened to the webbing between 6 and 6'. The other side of the compartment hangs free. Care must be taken that the storage compartment does not impede the expansion of the hammock.

Figure 7:
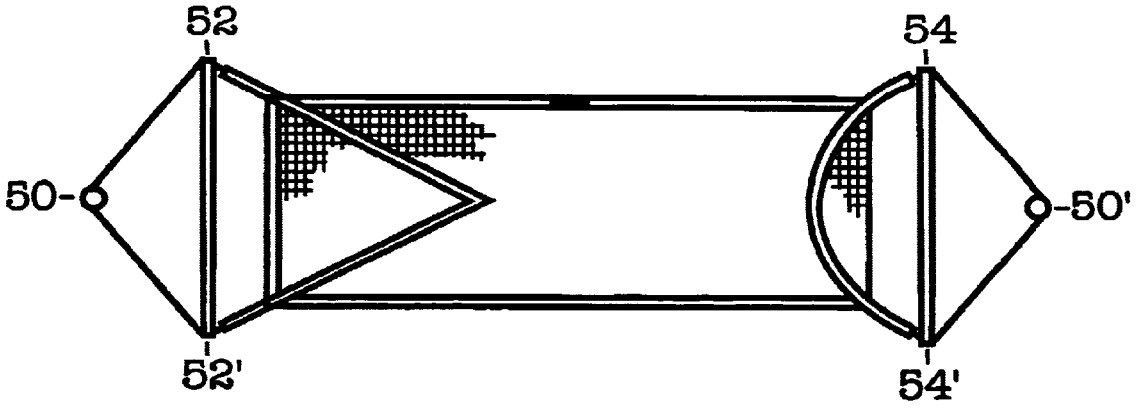
FIG. 7 shows a top view of the suspended hammock including the spreader bars and anchor points.

The hammock is suspended from non-stretch ropes tied to the four loops, FIG. 7. If only one anchor point is available at each end as shown by 50 and 50', two spreader bars are required, 52, 52' and 54, 54'. They must be slightly longer than the hammock is wide and can be wood, fiberglass or a collapsible metal version for camping use. The ends of the spreader bars are notched to allow easy insertion and removal from between the ropes. To cut down on weight, spreader bars can be omitted during camping trips where dead wood is available. Temporary replacement bars can then be manufactured from available dead wood at the camp sites. If four conveniently located anchor points are found, no spreader bars are needed.

Figure 8:
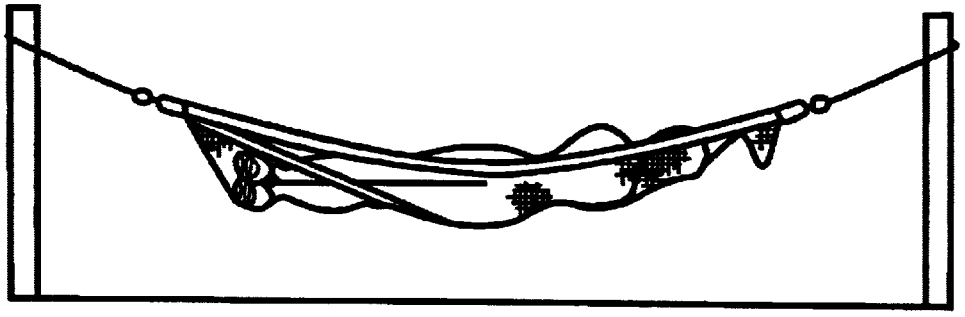
FIG. 8 depicts the posture of a person lying in the hammock and the shape of its bed under load.

In FIG. 8 the spreader bars are installed and the hammock is loaded. The ropes apply a forward and outward pull to the curved section of the webbing at the head end. The pleated bedding material allows the hammock to widen and the curved webbing to move forwards as it becomes straighter. This applies an evenly distributed forward pull on the non-stretch bedding material that is directly proportional to the load in the hammock. The V-shaped webbing attached to the foot end pulls counter to the forward force without lifting up the foot end of the bed. The two forces combined keep the hammock bed tight and flat and allow no more drooping than the hammock is designed for. FIG. 8 is reproduced from a photograph.

I claim:

1. A hammock comprising a bed made from non-stretch netting material with a dedicated head and foot section located at opposite ends of said bed, wherein said bed is shaped and structured to compensate for sag while the hammock is in use and under load without additional adjustment to said hammock, said bed being fastened along all edges to a rectangular non-stretch webbing frame and suspended longitudinally therefrom to substantially occupy a horizontal plane, said webbing frame being fastened to upright supports in a level and snug manner via a pair of ropes, each rope affixed to a pair of corners of said webbing frame at opposing shorter ends of said webbing frame wherein each corner in the pair of the corners is kept apart by spreader bars that are wider than said webbing frame's overall transverse dimension, said spreader bars inserted between respective ropes and adjacent to said webbing frame.

2. A hammock according to claim 1, wherein said compensation for sag is achieved by the netting material of the bed comprising an arch across the head section with the arch's curvature facing inward toward the foot section, wherein about one-third of the length of netting material of the bed located near the foot section has a free end and is shaped into a gradually increasing pre-determined width toward the free end, which allows the one-third of increased width of netting material to, when attached to the rectangular webbing frame, create a sag that has a base level with the lowest part of the netting material of the hammock when the hammock is in use and under load, said foot section having an insert comprising an arcuate bottom section and a linear top portion, the linear top portion being fastened to a short piece of webbing frame located across the foot section, and the arcuate bottom section attached to the free end of the one third of the netting material, wherein the insert is oriented perpendicular to the horizontal plane.

3. A hammock according to claim 2, wherein said arch of the head section is joined to the webbing frame in a slightly plicate manner, which allows the arches of both the netting material and the webbing frame to widen and pull said netting material toward said upright supports located at the head section as a load creates an outward draw on the curved webbing frame via the ropes and the spreader bars, said pull consequently tightening and lifting said netting material and thereby compensating for sag in the hammock and wherein two webbing straps are fastened to corners of the webbing frame at the foot section, said straps being sewn to the netting material of said bed and joined together in a V-shaped formation.

* * * * *